US006886631B2

(12) United States Patent
Wilson et al.

(10) Patent No.: US 6,886,631 B2
(45) Date of Patent: May 3, 2005

(54) INFLATION TOOL WITH REAL-TIME TEMPERATURE AND PRESSURE PROBES

(75) Inventors: Paul Wilson, Houston, TX (US); Kevin L. Gray, Friendswood, TX (US); John D. Roberts, Spring, TX (US); Corey E. Hoffman, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/212,672

(22) Filed: Aug. 5, 2002

(65) Prior Publication Data

US 2004/0020644 A1 Feb. 5, 2004

(51) Int. Cl.[7] ..... E21B 49/08

(52) U.S. Cl. ..... 166/250.07; 166/250.17; 166/53; 166/187

(58) Field of Search ..... 166/250.07, 250.17, 166/187, 53, 250.15

(56) References Cited

U.S. PATENT DOCUMENTS

| | | | | |
|---|---|---|---|---|
| 3,417,827 A | | 12/1968 | Smith et al. | |
| 4,492,383 A | | 1/1985 | Wood | |
| 4,898,236 A | | 2/1990 | Sask | |
| 5,868,201 A | * | 2/1999 | Bussear et al. | 166/53 |
| 6,055,213 A | * | 4/2000 | Rubbo et al. | 167/82 |
| 6,223,821 B1 | | 5/2001 | Coronado | 166/250.01 |
| 6,367,545 B1 | | 4/2002 | Van Buskirk et al. | 166/53 |

OTHER PUBLICATIONS

PCT International Search Report, International Application No. PCT/US03/24408, dated Jan. 2, 2004.

* cited by examiner

*Primary Examiner*—William Neuder
(74) *Attorney, Agent, or Firm*—Moser, Patterson & Sheridan

(57) ABSTRACT

Embodiments of the present invention generally provide a method, apparatus, and system for monitoring conditions in wellbore in real time prior to setting an inflatable element in the wellbore. The inflatable element is inflated with an inflation tool run on a cable with one or more electrically conductive wires (the cable is commonly referred to as a "wireline"). One or more sensors, internal or external to the inflation tool, are monitored before setting the inflatable element to verify well conditions are compatible with the inflatable element. The sensors may be internal or external to the inflation tool.

37 Claims, 8 Drawing Sheets

INFLATION TOOL WITH REAL-TIME TEMPERATURE AND PRESSURE PROBES

BACKGROUND OF THE INVENTION

1. Field of the Invention

Embodiments of the present invention generally relate to downhole production operations and particularly to inflatable tools used in such operations.

2. Description of the Related Art

Inflatable elements, such as inflatable packers and plugs, are commonly used in downhole production operations. The inflatable elements are typically inflated with wellbore fluids, or transported inflation fluids, via an inflation tool. The inflation tool may include a single or multi-stage downhole pump capable of drawing in wellbore fluids, filtering the fluids, and injecting the filtered fluids into the inflatable element. The inflatable element typically includes an inflatable section made of one or more elastomers. When the inflatable element is filled with fluids, the elastomers expand and conform to a shape and size of the wellbore or casing, thus creating a seal to isolate an area of the wellbore.

The inflation tool is typically operated via electricity supplied from a surface power supply via an electric cable, or "wireline." An operator at the surface may monitor voltage supplied to the inflation tool and current draw of the inflation tool to verify pump operations and to estimate the output pressure of the tool. For example, voltage supplied to the inflation tool and current draw of the inflation tool may be proportional to pump speed and pressure output, respectively. This data is typically collected at the surface from the power supply without any type of direct communication with the inflation tool. Downhole conditions, such as downhole temperature and pressure are typically not monitored while running and setting the inflatable element with the inflation tool.

However, downhole pressure and temperature can have a marked affect on the performance of an inflatable packer or plug. For example, the elastomers typically have very specific operating temperature ranges. If exposed to excessive temperature, the elastomers may degrade. A traditional approach to determine conditions in the wellbore, such as downhole temperature, prior to setting an inflatable element, is by prediction using historical data. For example, the temperature of the wellbore at the setting depth may be predicted from data from a previous logging run. However, because this approach may fail to properly account for changes in downhole conditions subsequent to the previous logging run, accuracy of these predictions may be limited.

Furthermore, inflatable products exposed to temperature excursions can experience broad variations of internal pressure after the tool has been set. In fact, it has been reported that the single-most cause of failure of inflatable products is a change in temperature after the tool has been set. The decision to use a thermal compensator, a mechanical device to compensate for the volume change of the inflation fluid due to temperature, may be based on the initial temperature at the setting depth and an estimation of the temperature excursion caused by events, such as producing the well or injecting treating fluids into the well. A traditional approach to estimating the temperature excursion is by using complex software techniques for modeling these events. However, due to complexity in modeling these events and the previously described uncertainty in establishing the initial temperature, the accuracy of these predictions are limited, as well.

One approach to increase a confidence in these predictions is to run sensors with the inflation tool to log data while setting the inflatable element. The data may be retrieved later to determine the accuracy of the estimates. However, this approach does not prevent damage to a tool in case well conditions are outside the operating ranges of the inflatable element.

Accordingly, what is needed is an improved method and apparatus for monitoring downhole conditions prior to, during, and after setting an inflatable element.

SUMMARY OF THE INVENTION

Embodiments of the present invention generally provide a method, apparatus, and system for monitoring downhole conditions in real time prior to setting an inflatable element in a wellbore. The method generally comprises lowering an assembly comprising the inflatable element, an inflation tool, and a probe having one or more sensors down a wellbore. Power is supplied to the probe through conductive wires of a cable supporting the assembly (i.e., a wireline). A signal generated by the probe is monitored to determine if one or more downhole parameters measured by the sensors are compatible with the inflatable element. If the downhole parameters are compatible with the inflatable element, the inflation tool is activated to inflate the inflatable element. For some embodiments, one or more sensors may be integrated with the inflation tool. For some embodiments, rather than inflate an inflatable element, the inflation tool may set a mechanical packer.

The apparatus generally comprises one or more pumps for inflating an inflatable element in a wellbore, one or more sensors for monitoring a corresponding one or more downhole parameters, and a control circuit. The control circuit is adapted to sequentially communicate data from the sensors to a surface of the wellbore and to operate the one or more pumps to inflate the inflatable element. For one embodiment, the control circuit may alternate between communicating sensor data and operating the one or more pumps on successive power cycles.

The system comprises an assembly lowered down a wellbore and an interface at a surface of the wellbore. The assembly generally comprises an inflatable element, an inflation tool, and a probe having one or more sensors. The probe is adapted to generate a signal to communicate data from the one or more sensors to the surface. The surface interface generally comprises circuitry to receive the signal generated by the probe and instrumentation for displaying data from the one or more sensors. An operator may monitor the instrumentation to verify downhole conditions are compatible with the inflatable element prior to operating the inflation tool.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally provide a method, apparatus, and system for monitoring downhole conditions in real time prior to setting an inflatable element in a wellbore. The inflatable element is inflated with an inflation tool run on a cable with one or more electrically conductive wires (the cable is commonly referred to as a "wireline"). One or more sensors, internal or external to the inflation tool, are monitored before setting the inflatable element to verify well conditions are compatible with the inflatable element, which may prevent damage to the inflatable element and/or catastrophic failure. An advantage to this approach is that well conditions may be determined more accurately than the traditional approach of estimating current well conditions based on historical data. Further, the one or more sensors may be monitored while inflating the inflatable element to confirm operation of the inflation tool. Still further, the one or more sensors may also be monitored to determine a change in well conditions, for example, due to intervention operations, such as injecting surface fluids.

Figure 1:
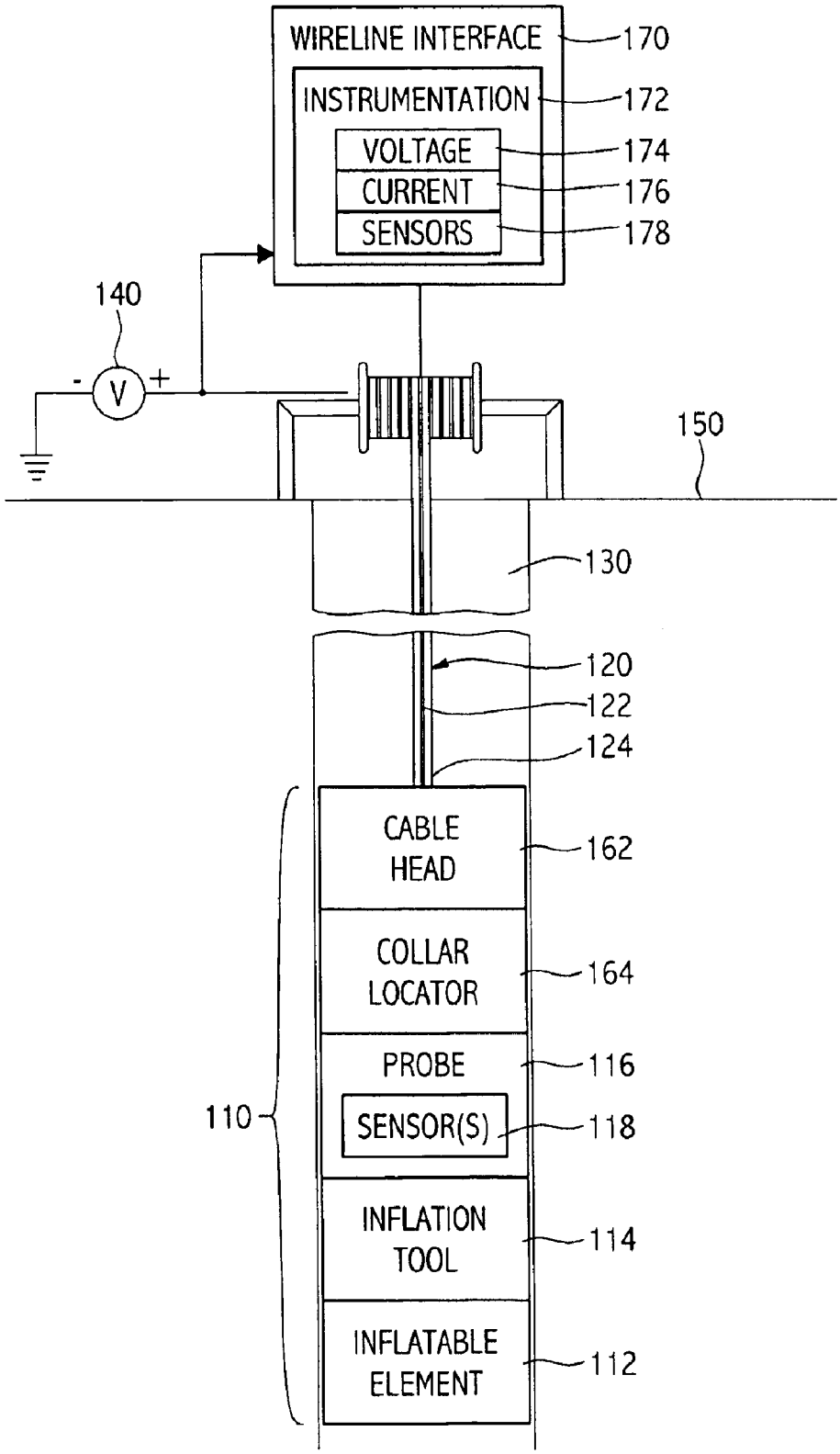
FIG. 1 illustrates an exemplary system according to one embodiment of the present invention.

FIG. 1 illustrates an exemplary system, according to one embodiment of the present invention, comprising a tool assembly 110 lowered down a wellbore 130 on a wireline 120 having one or more electrically conductive wires 122 surrounded by an insulative jacket 124. The tool assembly 110 includes an inflatable element 112, an inflation tool 114 and a probe 116 with one or more sensors 118. A cable head 162 connects the assembly 110 to the wireline 120 and provides electrical and mechanical connectivity to subsequent tools of the assembly 110, such as a collar locator 164, the probe 116 and the inflation tool 114.

The inflation tool 114 is a single or multi-stage downhole pump tool capable of drawing in fluids, filtering the fluids, and injecting the filtered fluids into the inflation element 112. The inflation tool 114 is operated via electricity supplied down the wires 122 of the wireline 120 from a power supply 140 at a surface 150 of the wellbore. The inflation tool 114 is operated at a voltage set by an operator at the surface 150. For example, the inflation tool 114 may be operated at 120 VDC. However, the operator may set a voltage at the surface 150 above 120 VDC (i.e. 160 VDC) to allow for voltage loss due to impedance in the electrically conductive wires 122.

A wireline interface 170 may include instrumentation 172 to provide the operator with feedback while operating the inflation tool 114. For example, the instrumentation 172 may include a voltage instrument 174 and a current instrument 176 to provide an indication of the voltage applied to the wireline 120 and the current draw of the inflation tool 114, respectively. The voltage and current draw of the inflation tool 114 may provide an indication of a state of the inflatable element 112. For example, a current draw of the inflation tool 114 may be proportional to a setting pressure of the inflatable element 112. The instrumentation 172 may comprise any combination of analog and digital instruments and may comprise a display screen similar to that of an oscilloscope, for example to allow an operator to view graphs of the voltage signal applied to the wireline 120.

The inflatable element 112 may be any type inflatable element suitable for downhole use, such as an inflatable plug or packer, and may be permanent or retrievable. As will be described below, for some embodiments, a mechanical packer may be used, rather than an inflatable element. Exemplary inflatable elements include Annulus Casing Packers (ACP), Injection Production Packers (IPP), and Inflatable Straddle Packers (ISP) available from Weatherford International, Inc. of Houston, Tex. The inflatable element 112 is typically inflated with wellbore fluids, or transported inflation fluids, via the inflation tool 114. The inflatable element 112 typically includes an inflatable section made of one or more elastomers. When the inflatable element 112 is filled with fluids, the elastomers expand and conform to a shape and size of the wellbore 130 or an inner surface of a casing (not shown) within the wellbore 130.

As previously described, the elastomers have specific operating ranges that must not be exceeded to ensure proper operation of the inflatable element 112. For example, the elastomers may degrade if exposed to temperatures outside their operating range. Therefore, one of the sensors 118 of the probe 116 may be a temperature sensor to monitor downhole temperature. The probe 116 may generate a signal to communicate data from the temperature sensor to the wireline interface 170, where the temperature data may be displayed on a sensor instrument 178. The wireline interface 170 may include any suitable circuitry to receive the signal generated by the probe 116 and condition the signal for display by the sensor instrument 178. An operator at the surface 150 may monitor the sensor instrument 178 to ensure downhole temperature is compatible with the inflatable element 112 prior to activating the inflation tool 114.

For other embodiments, however, the assembly 110 may be lowered down the wellbore 130 on a lowering member other than a wireline (e.g., a coiled tubing or slickline). In such embodiments, rather than transmit signals via conductive wires, the probe 116 may transmit wireless signals to communicate data to the surface 150. Further, in such embodiments, the assembly 110 may include a battery to power the inflation tool 114 and/or probe 116. Still further, the assembly may be configured to operate autonomously (i.e., without surface intervention) after receiving a triggering signal from a triggering device which may supply power to the inflation tool 114 and/or probe 116 from the battery. Operating tools deployed on lowering members other than wireline is described in an application, filed herewith on Aug. 5, 2002, entitled "Slickline Power Control Interface" (Attorney Docket Number WEAT/0234), hereby incorporated by reference.

Figure 2:
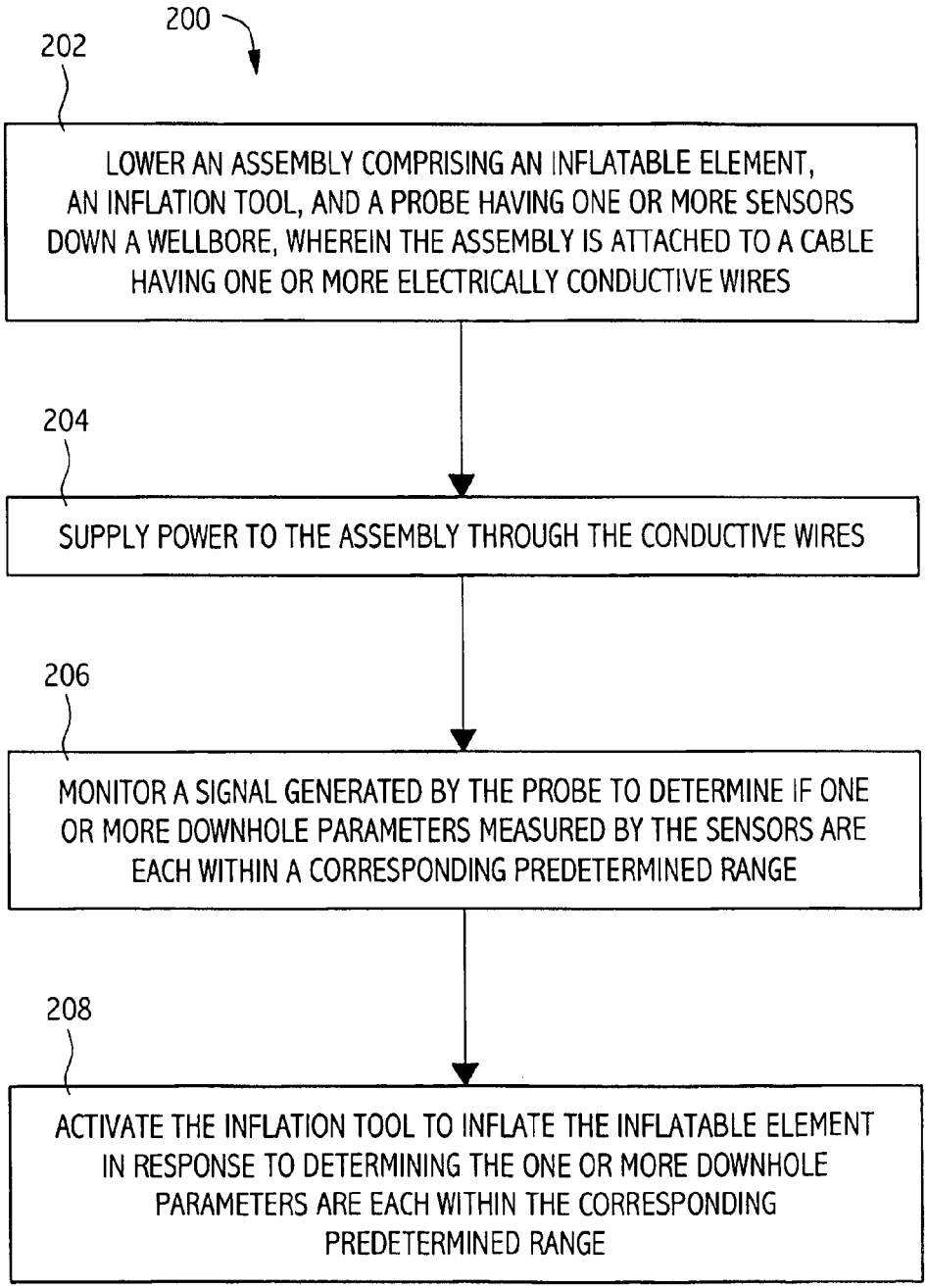
FIG. 2 is a flow diagram illustrating exemplary operations of a method for setting an inflatable element according to one embodiment of the present invention.

FIG. 2 is a flow diagram illustrating exemplary operations of a method 200 for setting an inflatable element according to one embodiment of the present invention. The operations of FIG. 2 may be described with reference to the exemplary system of FIG. 1. However, it will be appreciated that the exemplary operations of FIG. 2 may be performed by systems other than that illustrated in FIG. 1. Similarly, the exemplary system of FIG. 1 may be capable of performing operations other than those illustrated in FIG. 2.

The method 200 begins at step 202, by lowering an assembly comprising an inflatable element, an inflation tool, and a probe having one or more sensors down a wellbore. The assembly is attached to a cable having one or more electrically conductive wires (i.e., the wireline 120). For example, the assembly 110 may be lowered down the wellbore 130 while monitoring a signal generated by the collar locator 164 to determine a depth. Initially, no power may be supplied to the assembly 110, as the collar locator 164 may be a passive tool that generates an electrical pulse when passing variations in pipe wall, such as a collar of a casing within the wellbore 130. For some embodiments, the collar locator 164 may be a gamma-ray collar locator to correlate formation data with wellbore depths. Alternatively, a depth of the assembly 110 may be determined by simply monitoring a length of wireline 120 while lowering the assembly 110.

At step 204, power is supplied to the assembly through the conductive wires. For example, once the assembly 110 is at depth, power is supplied to the assembly 110 to activate the sensor probe 116. Once activated, the sensor probe 116 may begin to gather data from the one or more sensors 118. As previously described, the sensor probe 116 may generate a signal to communicate the sensor data to the wireline interface 170.

At step 206, a signal generated by the probe is monitored to determine if one or more downhole parameters measured by the sensors are each within a corresponding predetermined range. As previously described, the wireline interface 170 may contain interface circuitry to receive the signal generated by the probe 116, filter the signal, if necessary, and display the sensor information on the sensor instruments 178. An operator at the surface 150 may then read the sensor instruments 178 to determine if the one or more downhole parameters are within a specified operating range of the inflatable element 112. The one or more downhole parameters may include, but are not limited to, downhole temperature, downhole pressure, acidity of wellbore fluids, density of wellbore fluids, density of a formation proximate the wellbore, and gamma-ray emissions of a formation through which the wellbore extends.

At step 208, the inflation tool is activated to inflate the inflatable element in response to determining that each of the one or more downhole parameters is within the corresponding predetermined range. For example, if the downhole temperature is within the operating range of the inflatable element 112, the inflation tool 114 may be activated. For some embodiments, the inflation tool 114 may be activated by cycling power to the assembly 110. For example, the probe 116 and the inflation tool 114 may be attached to circuitry that acts as a toggle switch, toggling power between the probe 116 and the inflation tool 114 each time power is cycled to the assembly.

In other words, an operator at the surface 150 may momentarily supply power to the probe 116 in order to take a reading from the sensors 118, for example to confirm downhole temperature is compatible with the inflatable element 112. If the temperature is compatible, the operator may cycle power to the assembly 110 to activate the inflation tool 114 and inflate the inflatable element 112. Because a current draw of the inflation tool 114 is typically much higher (i.e. 600 ma) than a current draw of the probe (i.e. 80 ma), an operator at the surface 150 may readily ascertain the toggled position. Further, a voltage signal on the wire 122 generated by the probe 116 may be distinctly different than a voltage signal generated while operating a pump of the inflation tool 114. Circuitry to control which tool receives power may be supplied as an external component, or may be integrated with the probe 116.

An Exemplary Sensor Probe

Figure 3:
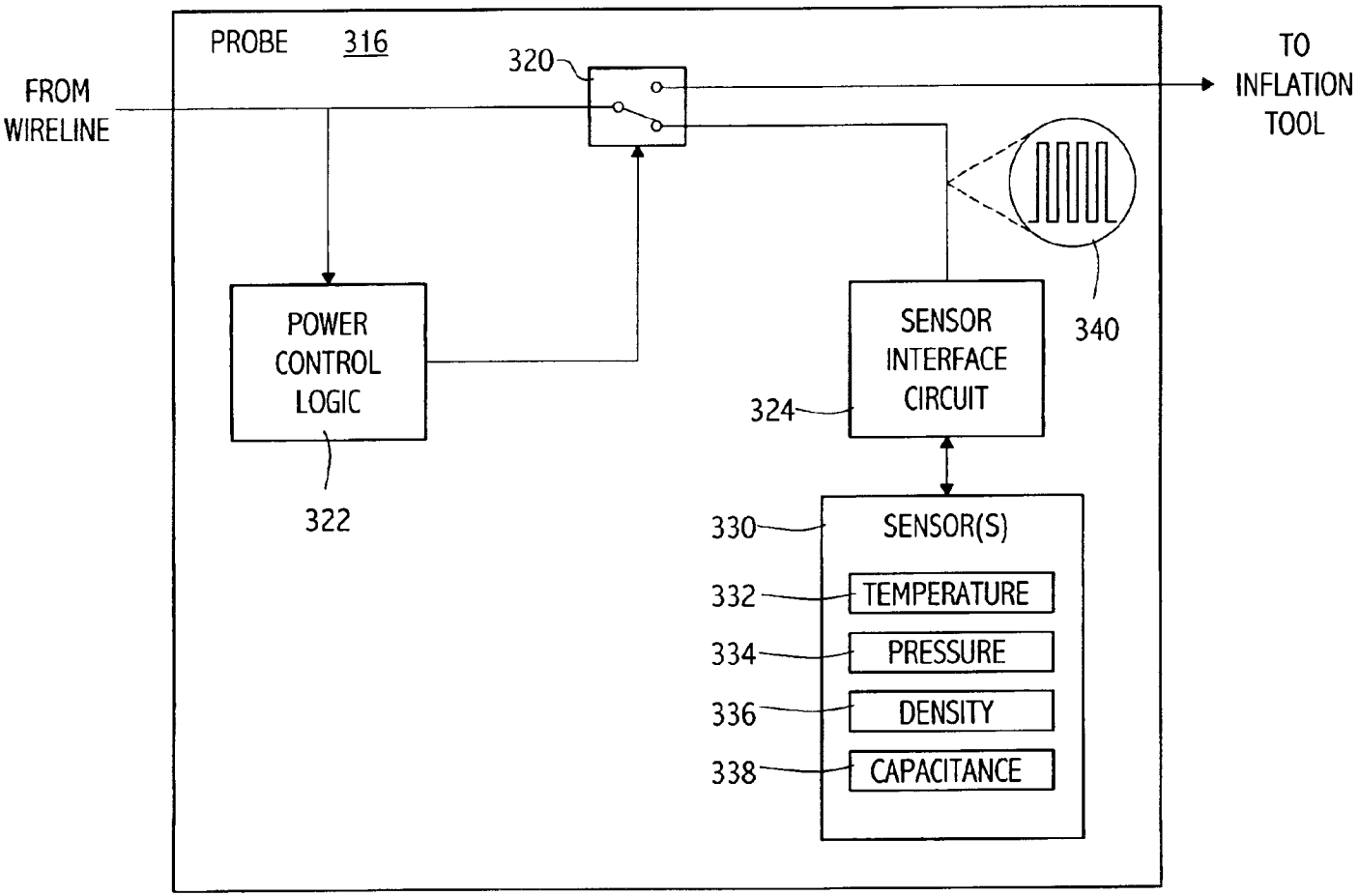
FIG. 3 is a block diagram of a sensor probe according to one embodiment of the present invention.

For example, as illustrated in FIG. 3, a probe 316 may comprise a switch 320 to supply power from the wireline to the inflation tool or sensor circuitry. Power control logic 322 may comprise any suitable circuitry to sense power from the wireline and generate a control signal to the switch 320. For example, the power control logic 322 may include a processor and nonvolatile memory. The processor may toggle a flag (i.e. a bit of a register) stored in the nonvolatile memory every power cycle to track power cycles. The switch 320 may comprise any suitable circuitry to switch the wireline voltage between the inflation tool and the sensor circuitry, such as any combination of mechanical relays, solid state relays, and/or field effect transistors (FETs).

The sensors 330 may comprise any combination of suitable sensors, such as a temperature sensor 332, a pressure sensor 334, a density sensor 336 and a capacitance sensor 338. For other embodiments, the sensors 330 may also include gamma-ray sensors or accelerometers. The sensor interface circuit 324 may comprise any suitable circuitry to read the one or more sensors 330 and generate a signal 340 to communicate sensor data to a wellbore surface. For example, the sensor interface circuit 324 may comprise A/D converters, operational amplifiers, processors and/or digital signal processing (DSP) circuits.

The signal 340 may be any suitable signal to communicate sensor data to the wellbore surface. For example, the signal may be a wired signal, a wireless signal or an acoustical signal. Further, a format of the signal may be any suitable format for transmitting the sensor data, such as frequency shift keying (FSK), or a data packet format according to a number of well known protocols. For some embodiments, the signal 340 may be an electrical AC signal superimposed on a DC voltage signal supplied to the probe 316 from the wireline. A frequency of the signal 340 may be proportional to a parameter measured by one of the sensors 330.

Figure 4:
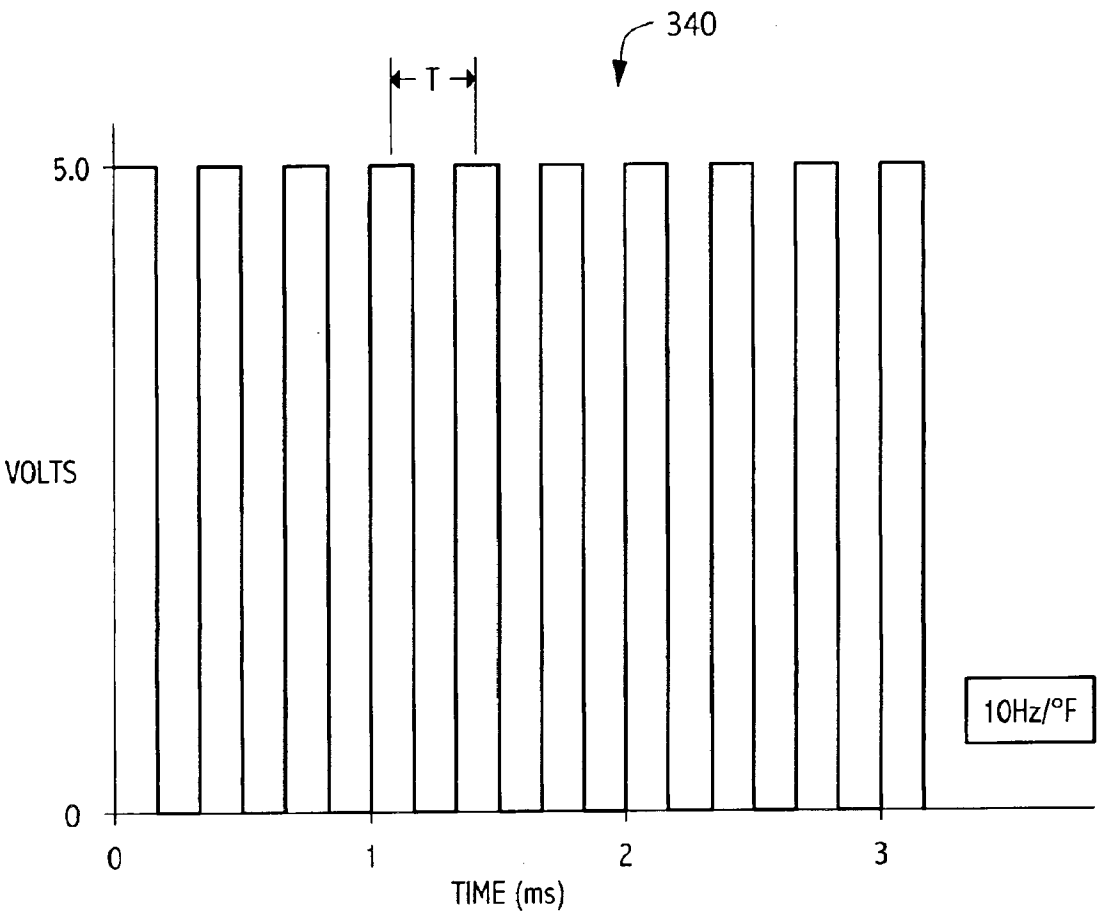
FIG. 4 illustrates an exemplary sensor signal generated on a wireline according to an embodiment of the present invention.

For example, FIG. 4 illustrates an exemplary sensor signal 340 that may be generated by the sensor interface circuit 324 in response to data from the temperature sensor 332. In the illustrated example, every 10 Hz of frequency corresponds to 1° F. For example, the illustrated signal 340 has a frequency of approximately 3 kHz, which would correspond to a temperature of approximately 300° F. Accordingly, the wireline interface 170 of FIG. 1 may include circuitry to filter the superimposed signal 340 from the wireline 120 and measure the frequency of the filtered signal. For example, depending on a frequency of the signal, the circuitry may simply count pulses or measure (and invert) a period (T) of the signal.

For another embodiment, the signal 340 may comprise a combination of positive and negative pulses. For example, for one embodiment, positive pulses may correspond to downhole temperature while negative pulses correspond to downhole pressure. An advantage to such an embodiment is that two sensors may be monitored from the surface without cycling power to the probe. Other suitable methods may be used to transmit data for two or more sensors over the wireline 120 without cycling power, such as well known multiplexing methods.

For example, using frequency division multiplexing (FDM), different sensors may be assigned different frequency ranges. The surface interface 170 may include circuitry to filter the different frequency ranges and extract the sensor data. Similarly, using time division multiplexing (TDM), time slices or "slots" may be assigned to different sensors. In a first time slice, for example, temperature data may be transmitted in a digital word (i.e. a packet of 8 binary bits or more), while in a second time slice, pressure data may be transmitted. The cycle may then repeat. Additional time slots may be added to accommodate additional sensors.

For some embodiments, these methods may also be used for communication from the surface to an assembly. For example, rather than cycle power to an assembly to switch between monitoring sensors and operating an inflation tool, an operator at the surface may transmit a digital command to the downhole tool to turn on or off the pumps. Furthermore, a digital TDM (or a variant thereof) may be used to transmit data from an inflation tool or probe while inflating the inflatable element. Accordingly, downhole parameters may be monitored before and during inflation.

As another example, pulse height signaling may be used to transmit data from one or more sensors. Pulse height signaling is a variant of the positive and negative signaling previously described. A positive pulse may be one of several pulse heights. For example, a positive pulse height of 1V could represent data from a temperature probe, a positive pulse height of 2V could represent data from a pressure probe, and a positive pulse height of 3V may represent data from a capacitance probe. Pulse height signaling may also be applied to negative pulse heights. Further, sensor data may be sent as a digital data packet using pulse height signaling. For example, each of the different voltage levels may constitute a digital bit in a word data value.

Further, pulse width modulation (PWM) may also be used to transmit data from one or more sensors. Using PWM, sensor data may be communicated by varying the width of a positive or negative going pulse. For example, data from a first sensor (i.e., a temperature sensor) may be transmitted by varying the time between a positive rising edge to the negative falling edge. Similarly, data from a second sensor (i.e. a pressure sensor) may be transmitted by varying the time between the negative falling edge and the next positive rising edge. One advantage of this technique may be an increased resolution.

An Exemplary Inflation Tool with Integrated Sensors

Figure 5:
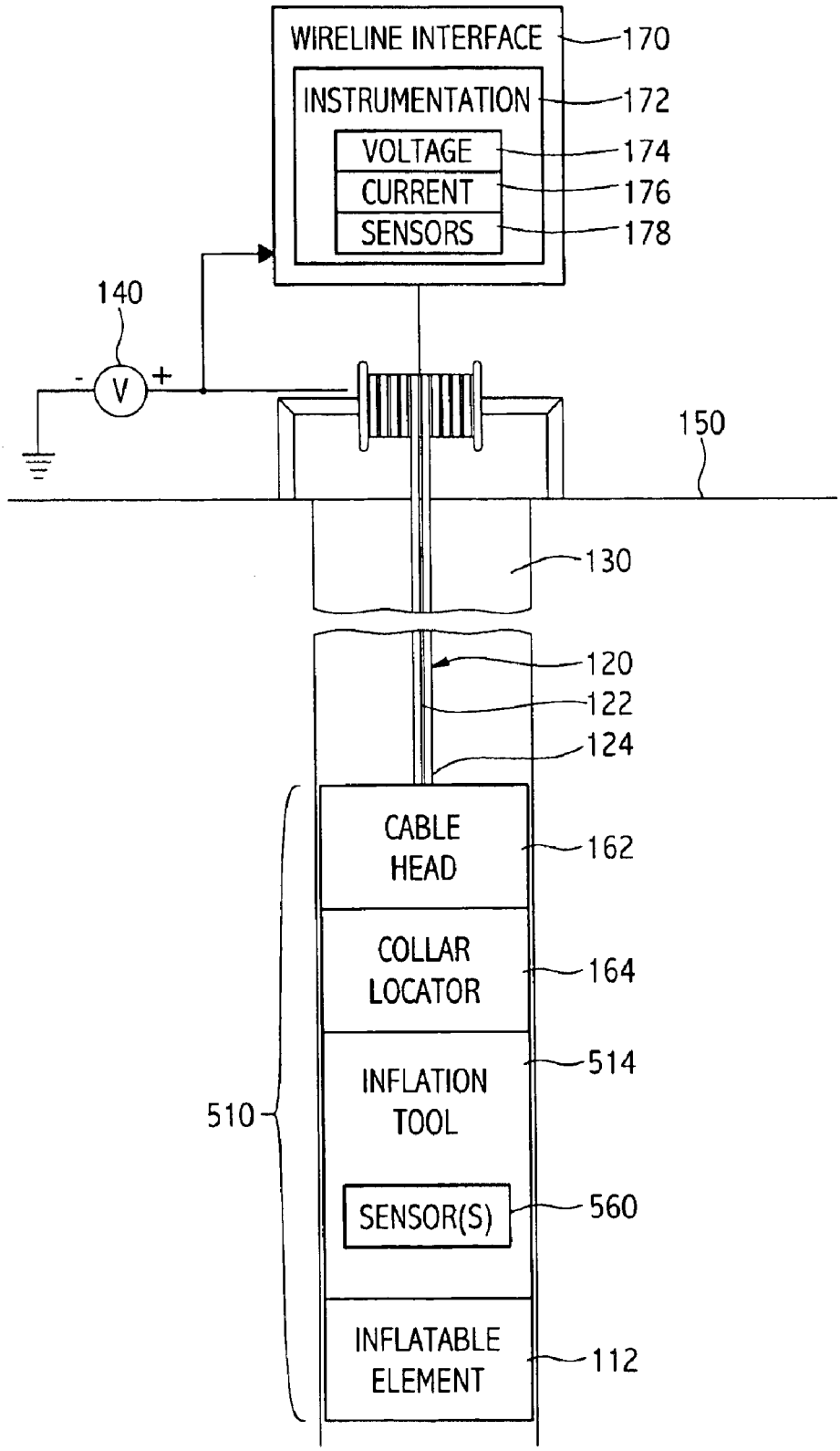
FIG. 5 illustrates an exemplary system according to another embodiment of the present invention.

FIG. 5 illustrates an exemplary system according to another embodiment of the present invention. The system of FIG. 5 utilizes an inflation tool 514 with integrated sensors 560, rather than a separate sensor probe (such as probe 116 of FIG. 1). For other embodiments, however, a separate sensor probe may also be used. For example, the integrated sensors 560 may monitor a first set of downhole parameters, while a separate sensor probe monitors a second set of downhole parameters. The inflation tool 514 may comprise circuitry to generate a signal to communicate data from sensors 560 to the wireline interface 170 and to toggle between communicating data and operating one or more pumps to inflate the inflatable element 112.

Figure 6:
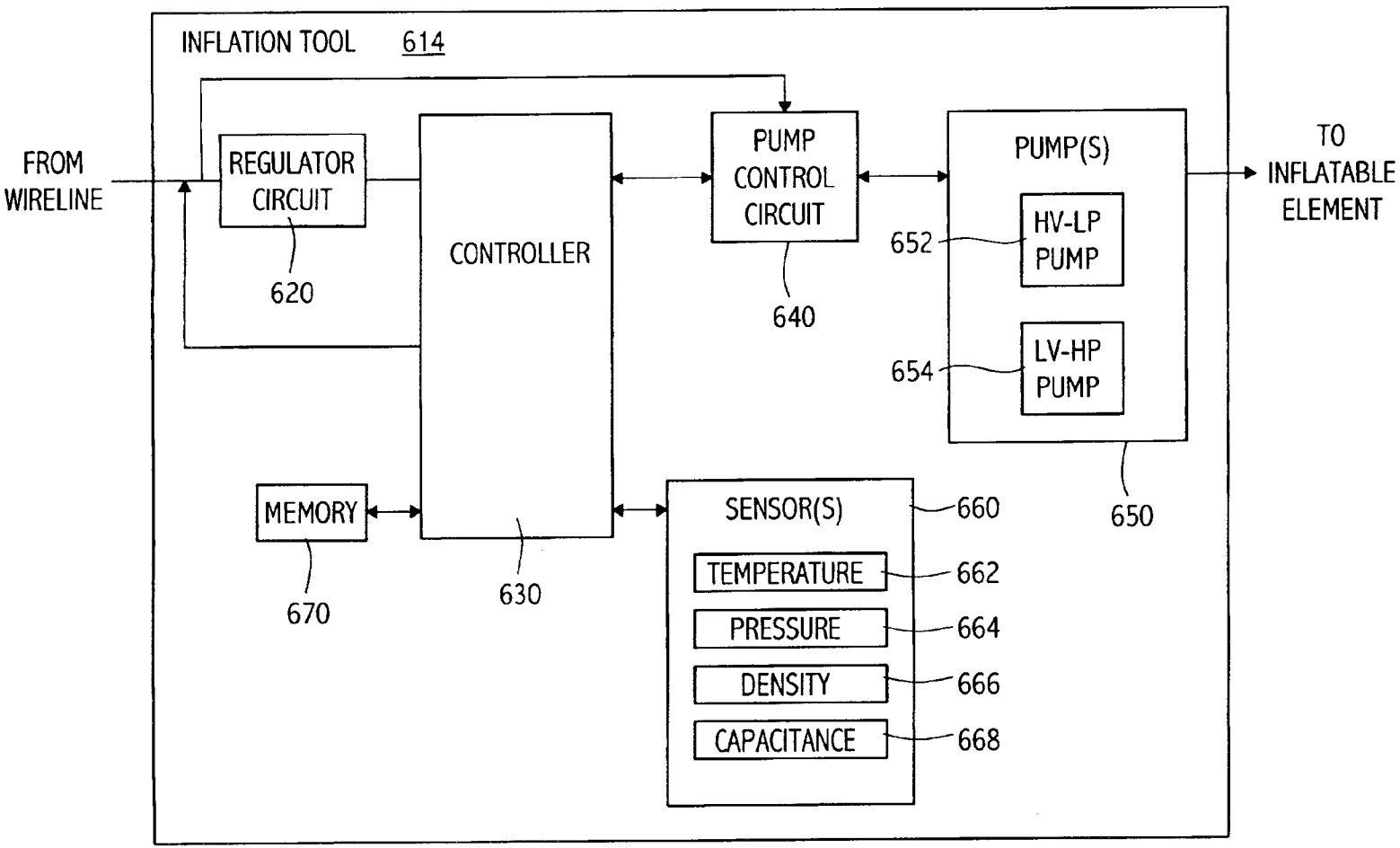
FIG. 6 is a block diagram of an inflation tool according to one embodiment of the present invention.

For example, as illustrated in FIG. 6, an inflation tool 614 may comprise a regulator circuit 620, control circuitry, such as controller 630 and pump control circuit 640, one or more pumps 650, and sensors 660. As illustrated, wireline voltage may be applied directly to the pump control circuit 640. However, the regulator circuit 620 may regulate the wireline voltage to a voltage suitable for operating additional circuitry of the inflation tool, such as the controller 630.

The controller 630 may include any suitable control circuitry, such as any combination of microprocessors, crystal oscillators and solid state logic circuits. The controller 630 may include any suitable interface circuitry to read sensors 660. For example, the controller 630 may include any combination of multiplexing circuits, signal conditioning circuits (filters, amplifier circuits, etc.), and analog to digital (A/D) converter circuits.

For some embodiments, the controller 630 may include an extended temperature microprocessor suitable for downhole operations, such as the 30100600 and 30100700 model microprocessors, available from Elcon Technology of Phoenix, Ariz., which are rated for operation up to 175° C. (347° F.). The microprocessor may communicate with a memory 670, which may be internal or external to the microprocessor and may be any suitable type memory. For example, the memory 670 may be a battery-backed volatile memory or a non-volatile memory, such as a one-time programmable memory (OT-PROM) or a flash memory. Further, the memory 670 may be any combination of suitable external or internal memories. For some embodiments, data gathered from sensors 660 may be logged into memory 670, for example, for later retrieval through a communications interface (not shown), such as a well known serial communications port.

The controller 630 may be adapted to allow a surface operator to toggle between monitoring data from the sensors 660 (i.e. a "sensor mode" and operating the one or more pumps 650 (i.e. a "pump mode"). The controller 630 may toggle between the sensor mode and the pump mode on successive power cycles. For example, on a first power cycle, the controller 630 may gather data from one or more of the sensors 660 and generate a signal to communicate the sensor data to a surface interface. On a second power cycle, the controller may operate the pumps 650 via the pump control circuit 640.

The pump control circuit 640 may comprise any suitable circuitry to supply wireline voltage to the pumps 650 in response to control signals generated by the controller 630. For example, the control circuit 640 may contain any suitable combination of mechanical relays, solid state relays, and/or field effect transistors (FETs). As illustrated, the pumps 650 may include a high volume-low pressure (HVLP) pump 652 and a low volume-high pressure (LV-HP) pump 654. A pump mode may comprise first operating the HV-LP pump 652 to inflate an inflatable element to a first pressure and subsequently operating the LV-HP pump 654 to inflate the inflatable element to a second, higher pressure. A surface operator may monitor a current draw of the inflation tool 614 to determine the HV-LP pump 652 has inflated the inflatable member to a predetermined pressure. The operator may then switch to the LV-HP pump 654, for example, by cycling power to the inflation tool 614. For some embodiments, switching between the HV-LP pump 652 and the LV-HP pump 654 may include reversing a polarity of the voltage supplied to the inflation tool 614.

For different embodiments, the controller 630 may implement any number of different sensor modes and pump modes to communicate data from different sensors 660 and/or operate different pumps 650, respectively. For example, in a sensor mode, the controller 630 may generate a signal to communicate data from a temperature sensor 662 on a first power cycle and generate a signal to communicate data from a pressure sensor 664 on a second power cycle. Additional sensors, such as a density sensor 666 and capacitance sensor 668 may be monitored on additional power cycles.

Figure 7:
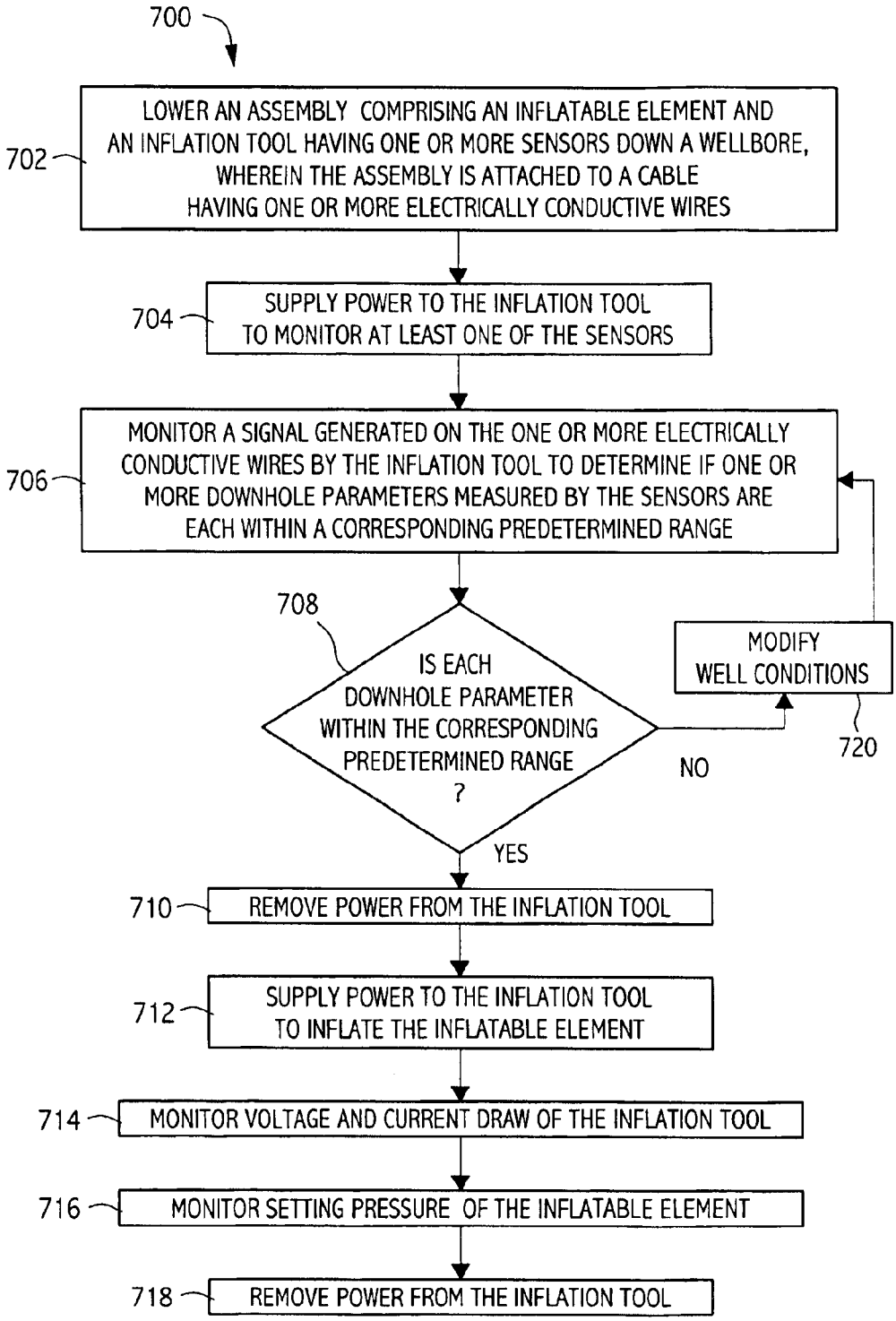
FIG. 7 is a flow diagram illustrating exemplary operations of a method for setting an inflatable element according to another embodiment of the present invention.

FIG. 7 illustrates a method 700 of setting an inflatable element with an inflation tool having one or more sensors.

The method 700 begins at step 702, by lowering an assembly comprising the inflatable element and the inflation tool down a wellbore, wherein the assembly is attached to a cable having one or more electrically conductive wires. At step 704, power is supplied to the inflation tool to monitor at least one of the sensors.

At step 706, a signal generated on the one or more electrically conductive wires by the inflation tool is monitored to determine if one or more downhole parameters measured by the sensors are each within a corresponding predetermined range. As previously described, for some embodiments, data from different sensors may be communicated over multiple power cycles. Therefore, additional power cycles may be required prior to determining each of the downhole parameters is within the corresponding predetermined range.

At step 708, if each of the downhole parameters is not within the corresponding predetermined range, well conditions may be modified at step 720. For example, fluids may be injected into the wellbore from a surface, in an effort to cool the wellbore fluids. The inflation tool may be left in place to continue monitoring downhole parameters after (or while) modifying the wellbore conditions. Accordingly, steps 706–710 may be repeated as necessary.

If each of the downhole parameters is within the corresponding predetermined range at step 708, however, the inflation tool is placed in a pump mode by removing power from the inflation tool at step 710 and supplying power to the inflation tool at step 712. At step 714, the voltage and current draw of the inflation tool is monitored. For example, as previously described, an operator may monitor the current draw to determine when to switch between a high volume-low pressure pump and a low volume-high pressure pump. For some embodiments, the inflation tool may be designed to automatically release from the inflatable element when the inflatable element is inflated to a predetermined release pressure. This automatic release may be indicated by a sharp decrease in the current draw of the inflation tool.

Alternatively, or in addition to monitoring a current draw of the inflation tool, a setting pressure of the inflatable element may be monitored at step 716. For example, the inflation tool may include a sensor for measuring pressure at an outlet to the inflatable element. Alternatively, the inflatable element may include a sensor for measuring setting pressure. The inflatable element may communicate data from the setting pressure sensor to the inflation tool by any suitable means, such as an acoustical signal. For some embodiments, data from the setting pressure sensor may be communicated to the inflation tool even after the inflation tool has released from the inflatable element, allowing for a direct measurement of setting pressure after the inflatable element has been set.

For some embodiments, an inflatable element may also include a sensor positioned to measure pressure below the inflatable element, which may allow for differential pressure measurements. For example, the inflatable element (or inflation tool) may also have a pressure sensor positioned to measure pressure above the inflatable element. In addition to, or in place of, pressure sensors at various locations, the inflatable element may also have any variety of other suitable sensors at various locations.

At step 718, power is removed from the inflation tool, for example, once it is determined the inflatable element has been inflated to a predetermined setting pressure and/or the inflation tool has released from the inflatable element. For some embodiments, the inflation tool may be left in place to continue monitoring other downhole parameters after the inflatable element has been set. While monitoring the downhole parameters after the inflatable element has been set may not prevent damage to the inflatable element, it may provide additional data to an operator which may lead to improved procedure on subsequent runs.

While the foregoing description has primarily focused on monitoring one or more downhole parameters, such as downhole temperature and pressure to ensure compatibility of wellbore conditions prior to setting an inflatable element, monitoring downhole parameters may also be useful for other operations. For example, some operations may require the injection of acid into the wellbore to displace existing wellbore fluids. During such an operation, acidity of the wellbore may be monitored, for example, with a capacitance sensor. The capacitance sensor may utilize wellbore fluids as a dielectric material between two plates. As acidity of the wellbore fluids change, dielectric properties of the wellbore fluid may also change, leading to changes in capacitance readings.

Figure 8:
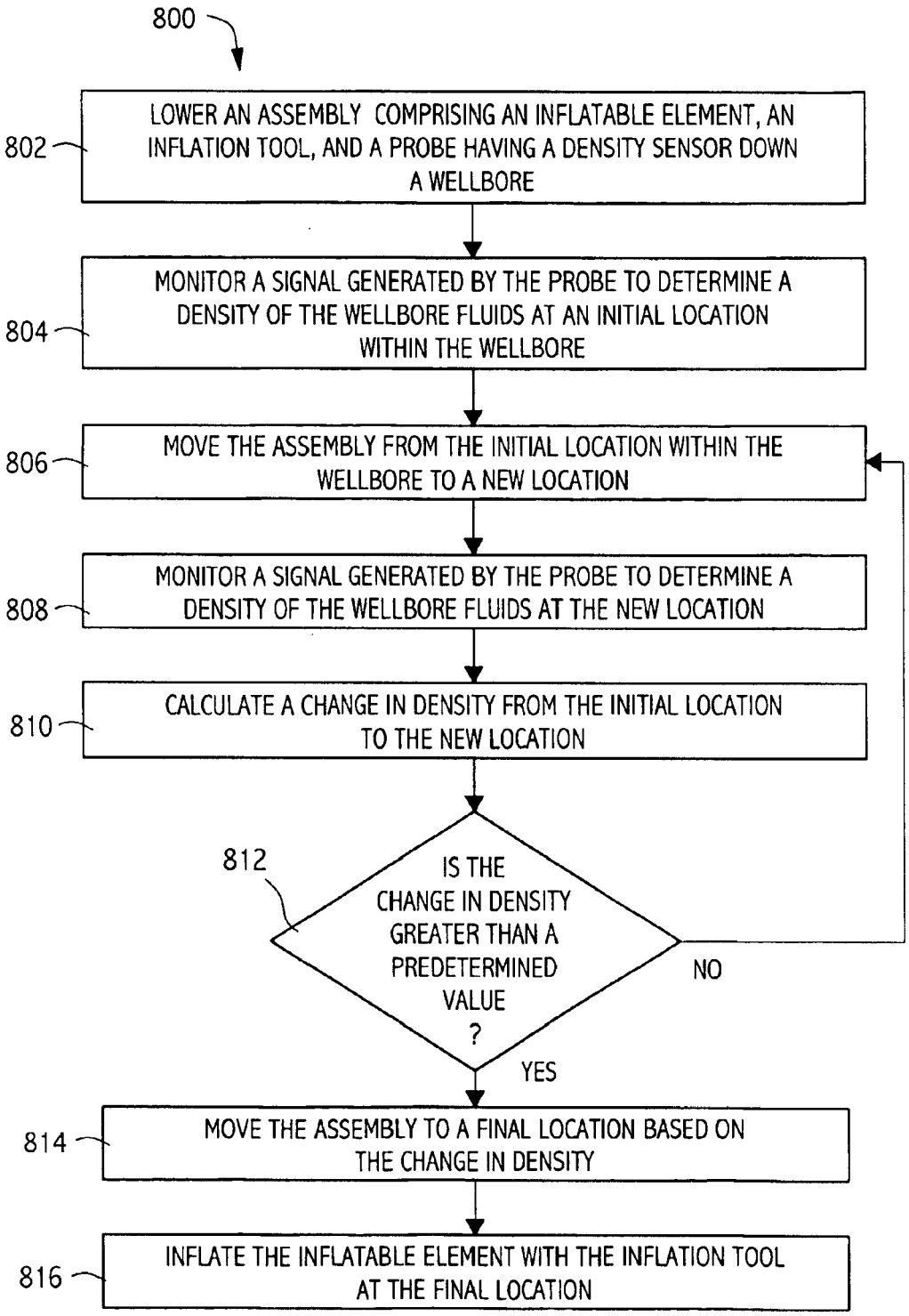
FIG. 8 is a flow diagram illustrating exemplary operations of a method for setting an inflatable element according to still another embodiment of the present invention.

As another example, a wellbore may traverse a producing zone and a water or gas zone. An inflatable element may be set in a position to isolate the producing zone from the water or gas zone. FIG. 8 illustrates a method 800 utilizing a density sensor that may be used for determining a setting position for the inflatable element to isolate the water or gas zone from the producing zone.

The method 800 begins at step 802, by lowering an assembly comprising an inflatable element, an inflation tool, and a probe having a density sensor down a wellbore. At step 804, a signal generated by the probe is monitored to determine a density of the wellbore fluids at an initial location within the wellbore. At step 806, the assembly is moved from the initial location to a new location. At step 808, a signal generated by the probe is monitored to determine a density of the wellbore fluids at the new location. At step 810, a change in density of the wellbore fluids from the initial location to the new location is calculated. A significant change in density from the initial location to the new location may indicate a significant change in a composition of the wellbore fluids. For example, the initial location may be in a producing zone while the new location is in a water or gas zone.

If the change in density is not greater than a predetermined value at step 812, the steps 806–810 may be iteratively repeated (using the new location as the initial location at step 806) until the change in density is greater than the predetermined value at step 812. The predetermined value may be determined, for example, based on the different densities of the wellbore fluids in the producing zone and the water or gas zone. A distance of each move at step 806 may be any suitable distance and may vary by application, for example, depending on the types of zones to be detected.

If the change in density of the wellbore fluids is greater than the predetermined value, at step 812, the assembly is moved to a final location at step 814. For example, the assembly may be moved back to a previous location (before the last move), or to a location in between the new location and the previous location. At step 816, the inflatable element is inflated with the inflation tool at the final location. For example, the inflatable element may be inflated at the final location in an attempt to isolate the water or gas zone from the producing zone.

For other embodiments, a similar method may comprise monitoring a density of a formation proximate the wellbore rather than the density of the fluid in the wellbore. For example, density measurements may be taken at different locations, prior to setting the tool at a final location based on the measured densities of the formation.

Setting Mechanical Elements

While the above description has primarily focused on setting inflatable elements, such as inflatable plugs and packers, embodiments of the present invention may also be utilized to set a mechanical element, such as a mechanical packer or plug. The mechanical elements functions in a similar manner to the inflatable elements, but are typically set by applying a hydraulic or mechanical force to squeeze an elastometric element that expands externally to seal the wellbore. As described above with reference to inflatable elements, the elastomers may have specific operating ranges that must not be exceeded to ensure proper operation of the mechanical packer. Accordingly, for some embodiments, prior to, or while setting a mechanical element, downhole parameters, such as downhole temperature and pressure may be monitored to ensure compatibility with the element.

While hydraulically set mechanical elements are typically set with high pressure fluids supplied via a coiled tubing, for some embodiments, an inflation tool run on electric wireline may be adapted to set the mechanical element. For example, a hydraulic setting tool may be attached to the inflation tool. The inflation tool may be adapted to supply the hydraulic setting tool with high pressure fluids typically supplied through the coiled tubing. As another example, a pyrotechnic/mechanical setting tool (commonly referred to as a power setting tool) may be used, in place of the inflation tool, to set a mechanical element via wireline. The power setting tool converts pressure generated internally from a black powder charge to a mechanical pull along a centerline of the tool.

An advantage to setting the mechanical element on a wireline is that, as previously described with reference to inflatable elements, a sensor probe, internal or external to the inflation tool or setting tool may transmit sensor data via the wireline to a surface operator. Accordingly, a surface operator may then validate downhole conditions are compatible with the mechanical packer prior to setting the mechanical packer. Those skilled in the art will also appreciate that setting the mechanical element on wireline may also be quicker and less expensive than setting the mechanical element on coiled tubing.

CONCLUSION

Embodiments of the present invention provide a method, system and apparatus for setting an inflatable or mechanical element in a wellbore. One or more sensors, internal or external to an inflation tool or setting tool used to set the element, may be monitored by an operator at a surface of the wellbore to verify downhole conditions are compatible with the element prior to setting the element. Accordingly, costly damage to the element may be avoided, as well as costly rework which may be required in an event the element fails.

While the foregoing is directed to embodiments of the present invention, other and further embodiments of the invention may be devised without departing from the basic scope thereof, and the scope thereof is determined by the claims that follow.

What is claimed is:

1. A method for setting an inflatable element in a wellbore, comprising:

lowering an assembly comprising the inflatable element, an inflation tool and a probe with one or more sensors into the wellbore, wherein the assembly is attached to a cable having one or more conductive wires;

supplying power to the assembly through the one or more conductive wires;

monitoring a signal generated by the probe on the conductive wires to determine if one or more downhole parameters measured by the sensors are each within a corresponding predetermined range for setting the inflatable element, the signal being superimposed on a voltage signal supplied to the probe through the conductive wires; and activating the inflation tool to inflate the inflatable element in response to determining that the one or downhole parameters are each within the predetermined range.

2. The method of claim 1, wherein a frequency of the signal generated by the probe is proportional to at least one of the downhole parameters measured by the sensors.

3. The method of claim 1, wherein:

one of the downhole parameters measured by the one or more sensors is a temperature in the wellbore; and activating the inflation tool comprises activating the inflation tool in response to determining the temperature in the wellbore is within the operating temperature range of the inflatable element.

4. The method of claim 1, wherein activating the inflation tool to inflate the inflatable element comprises removing power from the assembly and again supplying power to the assembly.

5. A method for setting an inflatable element comprising:

lowering an assembly comprising the inflatable element, an inflation tool comprising a first pump, and one or more sensors down a wellbore, wherein the assembly is attached to a lowering member;

supplying power to the one or more sensors through conductive wires;

monitoring a signal generated by the one or more sensors to determine if one or more downhole parameters measured by the sensors are each within a corresponding predetermined range; and in response to determining that the one or more downhole parameters are each within the predetermined range, inflating the inflatable element by removing power from the one or more sensors and supplying power to the first pump.

6. The method of claim 5, wherein at least one of the sensors is integrated with the inflation tool.

7. The method of claim 6, wherein at least one of the sensors integrated with the inflation tool is a pressure sensor.

8. The method of claim 5, wherein at least one of the sensors is a pressure sensor for measuring setting pressure of the inflatable element.

9. The method of claim 5, wherein at least one of the sensors is a capacitance sensor.

10. The method of claim 5, wherein:

the inflation tool further comprises a second pump; and the method further comprises the step of removing power from first pump, and then supplying power to the second pump to further inflate the inflatable element.

11. The method of claim 10, further comprising reversing a polarity of a voltage signal supplied to the inflation tool prior to again supplying power to the inflation tool.

12. The method of claim 5, wherein the lowering member is a cable having one or more conductive wires, and the method further comprises:

modifying conditions in the wellbore in response to determining one or more downhole parameters are not within the predetermined range; and monitoring a signal generated on the one or more conductive wires by the inflation tool to detect a change in wellbore conditions.

13. An inflation tool for inflating an inflatable element in a wellbore comprising:

(a) one or more sensors for measuring a corresponding one or more parameters in the wellbore;

(b) one or more pumps for inflating the inflatable element; and (c) control circuitry adapted to sequentially switch between:

(i) communicating data gathered from the one or more sensors to a surface of the wellbore, wherein the signal generated by the inflation tool is either an electrical AC signal superimposed on a DC voltage signal supplied to the inflation tool on one or more conductive wires, or the control circuitry communicates data gathered from the one or more sensors to a surface of the wellbore by sending data packets over the one or more conductive wires, and (ii) controlling the one or more pumps to inflate the inflatable element.

14. The inflation tool of claim 13, wherein at least one of the sensors is a temperature sensor for measuring downhole temperature.

15. The inflation tool of claim 14, wherein at least one of the sensors is a pressure sensor.

16. The inflation tool of claim 13, wherein at least one of the sensors is a density sensor.

17. The inflation tool of claim 13, wherein the inflation tool is operated from power supplied through one or more conductive wires of a cable.

18. The inflation tool of claim 17, wherein the control circuitry communicates data gathered from the one or more sensors to a surface of the wellbore by generating a signal on the one or more conductive wires.

19. The inflation tool of claim 13, wherein the control circuitry comprises circuitry to sense power cycles and, for different power cycles, the control circuitry either communicates data gathered from the one or more sensors to a surface of the wellbore or controls the one or more pumps to inflate the inflatable element.

20. The inflation tool of claim 13, wherein the one or more pumps comprise a low volume-high pressure pump and a high volume-low pressure pump.

21. A method for setting an inflatable element in a wellbore comprising:

(a) lowering an assembly comprising the inflatable element, an inflation tool, and a density sensor down a wellbore;

(b) measuring a density of a formation proximate the wellbore with the density sensor;

(c) comparing the measured density at depths along the wellbore to a determined density value; and (d) setting the inflatable element at a desired location within the wellbore, the desired location determined by the results of the comparison.

22. The method of claim 21, wherein measuring the density of the formation proximate the wellbore with the density sensor is performed at a new location and the determined density value is a density value measured by the density sensor at a previous location within the wellbore.

23. The method of claim 22, further comprising, if a change in density greater than a predetermined amount from the previous location to the new location is detected, moving the assembly to a final location prior to inflating the inflatable element with the inflation tool.

24. The method of claim 21, wherein the density sensor is integrated with the inflation tool.

25. The method of claim 24, wherein the assembly is lowered down the wellbore attached to a cable having one or more wires and the method further comprises:

prior to monitoring the density signal, supplying a first voltage signal to the inflation tool through the conductive wires; and prior to inflating the inflatable element with the inflation tool, removing the first voltage signal from the inflation tool and supplying a second voltage signal to the inflation tool through the conductive wires.

26. A system for setting an inflatable element in a wellbore comprising an assembly comprising the inflatable element, an inflation tool and a probe having one or more sensors to measure one or more downhole parameters, wherein the assembly is attached to a cable having one or more electrically conductive wires and the probe is adapted to generate a signal on the one or more conductive wires to communicate data from the one or more sensors to a surface of the wellbore; and an interface at a surface of the wellbore comprising circuitry to receive the signal generated by the probe and instrumentation to display the one or more downhole parameters measured by the sensors; and wherein a frequency of the signal generated by the probe is proportional to at least one of the downhole parameters measured by the sensors, and the interface circuitry comprises circuitry to measure a frequency of the signal.

27. The system of claim 26, wherein the signal generated by the probe is superimposed on a voltage signal applied to the conductive wires at the surface of the wellbore.

28. The system of claim 27, wherein the instrumentation comprises instrumentation for displaying a current draw of the assembly.

29. A method for setting an inflatable element comprising:

lowering an assembly into a wellbore on a wireline, the assembly comprising the inflatable element, an inflation tool and one or more sensors down a wellbore;

monitoring a signal generated by the assembly to determine if one or more downhole parameters measured by the sensors are each within a corresponding predetermined range;

in response to determining the one or more downhole parameters are each within the predetermined range, inflating the inflatable element;

modifying conditions in the wellbore in response to determining that one or more of the downhole parameters are not within the predetermined range; and monitoring a signal generated on the one or more conductive wires by the inflation tool to detect a change in wellbore conditions.

30. The method of claim 29, wherein at least one of the sensors is integrated with the inflation tool.

31. The method of claim 30, wherein at least one of the sensors integrated with the inflation tool is a pressure sensor.

32. The method of claim 29, wherein at least one of the sensors is a pressure sensor for measuring setting pressure of the inflatable element.

33. The method of claim 29, wherein at least one of the sensors is a capacitance sensor.

34. The method of claim 29, wherein the inflation tool comprises at least two pumps and inflating the inflatable element comprises removing power from the inflation tool and again supplying power to the inflation tool to switch from operating a first one of the pumps to operating a second one of the pumps.

35. The method of claim 34, further comprising reversing a polarity of a voltage signal supplied to the inflation tool prior to again supplying power to the inflation tool.

36. A system for setting an inflatable element in a wellbore comprising:

an assembly comprising the inflatable element, an inflation tool and a probe having one or more sensors to measure one or more downhole parameters, wherein the assembly is attached to a cable having one or more electrically conductive wires and the probe is adapted to generate a signal on the one or more conductive wires to communicate data from the one or more sensors; and an interface comprising circuitry to receive the signal generated by the probe and instrumentation to display the one or more downhole parameters measured by the sensors; and wherein a frequency of the signal generated by the probe is proportional to at least one of the downhole parameters measured by the sensors and the interface circuitry comprises circuitry to measure a frequency of the signal.

37. The system of claim 36, wherein the instrumentation comprises instrumentation for displaying a current draw of the assembly.

* * * * *